US005638877A

United States Patent [19]

April

[11] Patent Number: 5,638,877

[45] Date of Patent: Jun. 17, 1997

[54] STAKE SHARPENING APPARATUS

[76] Inventor: Norman J. April, 2 Cheryl Road, Nepean, Ontario, Canada, K2G 0V6

[21] Appl. No.: 541,512

[22] Filed: Oct. 10, 1995

[51] Int. Cl.[6] ..... B27M 3/00; B27C 1/00

[52] U.S. Cl. ..... 144/30; 144/176; 144/181.3; 144/168; 144/242.1

[58] Field of Search ..... 144/4, 30, 162.1, 144/168, 176, 181.3, 242.1, 134.1; 135/118

[56] References Cited

U.S. PATENT DOCUMENTS

| | | | |
|---|---|---|---|
| 307,505 | 11/1884 | Tiley | 144/30 |
| 562,128 | 6/1896 | Frost | 144/30 |
| 2,637,356 | 5/1953 | Skates et al. | 144/30 |
| 2,712,842 | 7/1955 | Fahrni | 144/162.1 |
| 3,111,971 | 11/1963 | Spencer | 144/30 |
| 3,118,476 | 1/1964 | Fiore | 144/30 |
| 4,317,544 | 3/1982 | Lapointe | 144/176 |
| 5,109,896 | 5/1992 | Tomes et al. | 144/30 |
| 5,323,975 | 6/1994 | Fulghum, Jr. | 144/176 |

*Primary Examiner*—W. Donald Bray
*Attorney, Agent, or Firm*—Michael M. Sakovich

[57] ABSTRACT

Apparatus for fashioning a pointed end on a stake includes a base on which is mounted a rotatably driven slotted circular disk having secured to one side thereof a plurality of cutting blades co-disposed in a radially outward arrangement within a cutting plane of the disk. A feed table is displaceably mounted on the base adjacent the cutting plane of the disk and supports a hollow cylinder having open ends for receiving a wooden stake and retaining a free end thereof in a predetermined angular cutting engagement with the cutting plane. Forward travel of the stake through the cylinder is limited by a stop member and lateral displacement of the stake relative to the cutting plane is provided by a handle operated cam that controllably moves the feed table to establish a predetermined depth of cut. The stake is rotated within the cylinder either manually or by a motor driven rotator which results in pinpointing the extended end of the stake.

16 Claims, 6 Drawing Sheets

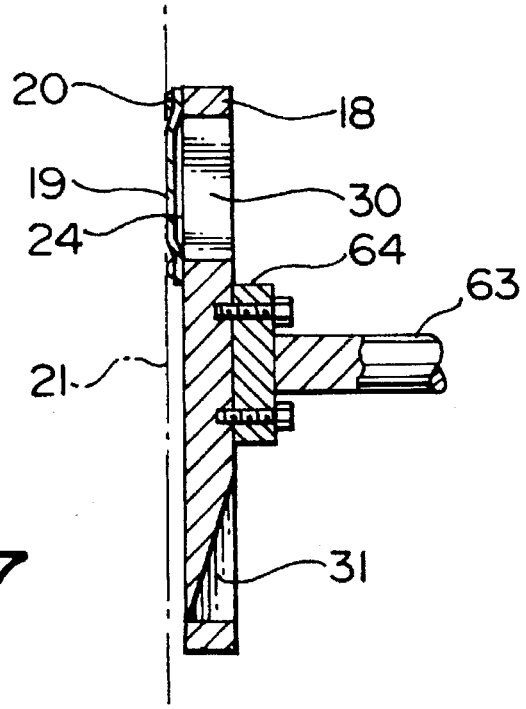
FIG. 7
FIG. 8
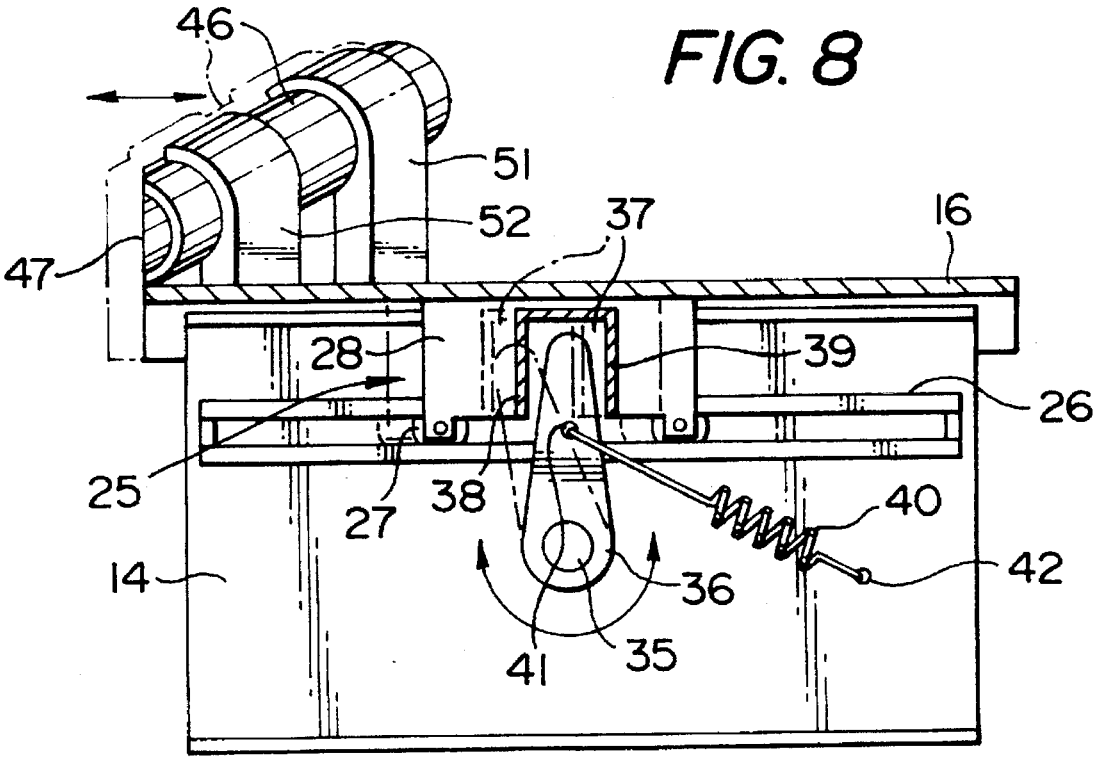

STAKE SHARPENING APPARATUS

FIELD OF THE INVENTION

The present invention relates to pinpointing apparatus generally and, in particular, to such improved apparatus having utility as a stake sharpener.

BACKGROUND OF THE INVENTION

Pinpointing apparatus is commonly found in the form of a rotary type pencil sharpener which is well suited to small workpiece sharpening operations. One usual form of such pencil sharpener comprises a pair of cylindrical rollers having a plurality of helical cutting surfaces formed along the longitudinal periphery of each roller. The long axis of each roller is positioned at an angle with respect to a longitudinal sharpening axis about which the rollers both rotate in a manner such that each roller turns about its own axis counter-rotatively with respect to the other roller as both rollers rotate about the sharpening axis. A pencil inserted at a divergent open end of the inclined rollers has a point formed thereon as it is urged towards the converging end of the rollers.

In the case of pinpointing larger objects such as surveying stakes, posts, columns and the like, certain problems can be expected with a pencil sharpening apparatus that is upscaled to accommodate larger workpieces. For example, larger cutting rollers would be substantially more costly to produce than their smaller counterparts used in pencil sharpeners. Moreover, the plurality of helical cutting surfaces would likely require expensive periodic sharpening since sharpening a cutting surface in the form of a helix is a relatively complex procedure that is not easily performed in the field. Furthermore, even a single damaged cutting surface could be beyond repair which would then necessitate replacing the entire roller.

Another form of useful pinpointing apparatus employs a cutting tool holder that may be either conical or cylindrical in form. A plurality of cutting blades are mounted on inner side walls of the tool holder which is rotatably driven. Thus, a workpiece urged coaxially into a rotating conical tool holder will have the inserted end cut into a conical shape as disclosed in U.S. Pat. No. 3,118,476 Fiore.

In the case of the cylindrically shaped cutting tool holder, a workpiece rotatably urged inside the holder against the rotating side wall at an angle will form a point corresponding to the angle of entry as disclosed in U.S. Pat. No. 5,109,896 Tomes et al.

The relatively complex shape of the tool holders in the aforenoted pinpointing apparatus suggests equipment that is costly to both manufacture and maintain.

SUMMARY OF THE INVENTION

Having regard to the aforedescribed problems relating to the cost factors of manufacturing and maintaining pinpointing apparatus in large scale applications, a principal objective of the present invention is to provide pinpointing apparatus that is economical to manufacture and maintain.

A further provision of the invention is pinpointing apparatus having a flat cutting disk on which is mounted at least one cutting blade in a cutting plane of the disk.

Another provision of the invention is stake sharpening apparatus utilizing inexpensive, readily replaceable cutting blades.

The problems associated with the prior art may be substantially overcome and the foregoing provisions achieved by recourse to the invention which relates to apparatus for pinpointing a workpiece that comprises, in combination, a base having a mounting surface thereon, cutting means rotatably supported on the mounting surface, the means including a flat disk having at least one cutting member radially disposed and secured thereon in a cutting plane of the disk, drive means mounted on the base and coupled to the cutting means for rotatably driving the disk, a feed table disposed on the mounting surface in adjacent relation to the cutting plane of the disk and support means mounted on the feed table for supportively engaging a free end of the workpiece in predetermined angular relation with the cutting plane of the disk.

BRIEF DESCRIPTION OF THE DRAWINGS

The invention will now be more particularly described with reference to embodiments thereof shown, by way of example, in the accompanying drawings in which:

FIG. 7 is a cross-sectional view of the disk in FIG. 6 taken along the lines 7—7;

FIG. 8 is a cross-sectional view of the apparatus shown in FIG. 5 taken along the lines 8—8;

DETAILED DESCRIPTION OF THE PREFERRED EMBODIMENTS

Figure 1:
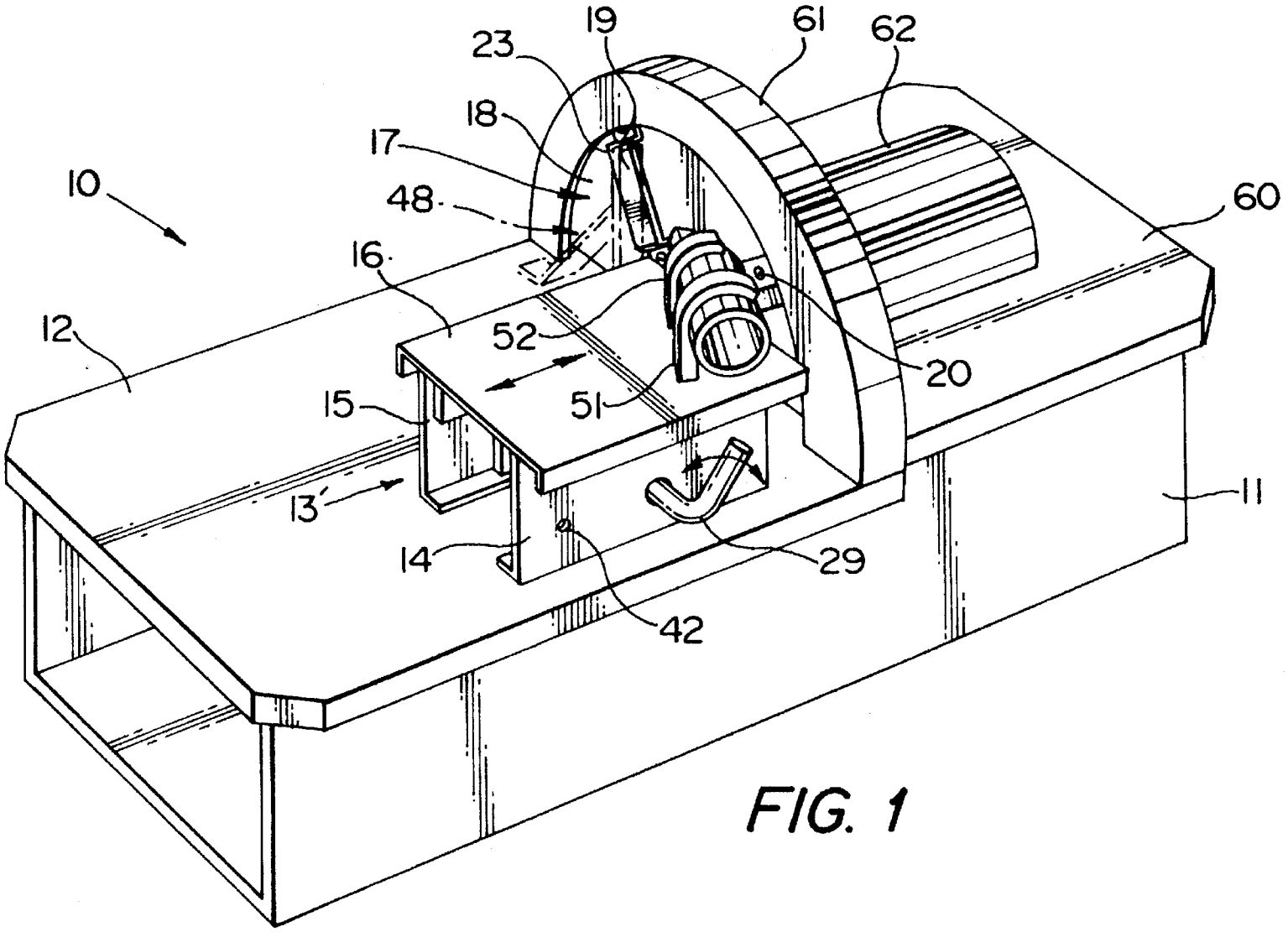
FIG. 1 is a perspective view of a stake sharpening apparatus in accordance with the present invention.

A perspective view of an apparatus 10 for sharpening a workpiece, such as a stake, is illustrated in FIG. 1. As shown, the apparatus includes a base 11 having a workpiece mounting surface 12 on which is affixed a stand 13' that comprises a pair of upstanding side walls 14 and 15. The walls are positioned in spaced apart relation to support a feed table 16 in adjacent relation to a cutting tool assembly 17.

The assembly 17 comprises a thick, circular disk 18 having a flat surface on which is mounted four cutting blades 19 that are each secured to the disk 18 by means of two fasteners 20. It will be understood from FIGS. 1 and 7 that the blades 19 are attached to the disk 18 in a cutting plane 21 thereof which is substantially orthogonal to the surface 12.

Figure 2:
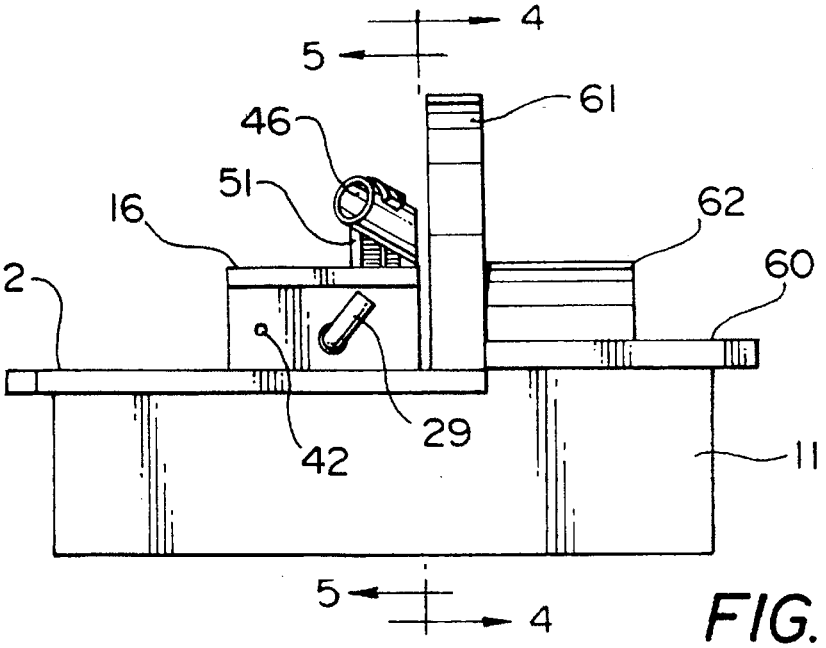
FIG. 2 is a side elevation view of the apparatus shown in FIG. 1.
Figure 5:
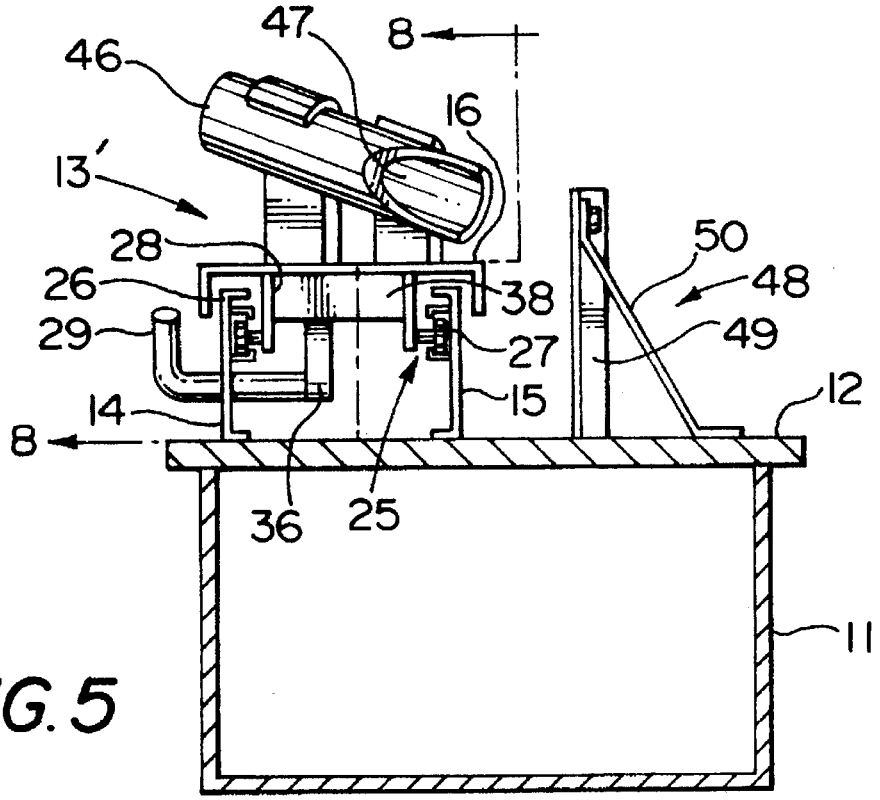
FIG. 5 is a cross-sectional view of the apparatus shown in FIG. 2 taken along the lines 5—5.

FIG. 5 shows an end view of a carriage assembly 25 mounted on an inwardly facing surface of each side wall 14 and 15. Each assembly 25 comprises a running track 26 within which is captively retained a pair of wheels 27 that are rotatably journalled in an angle bracket 28 (FIG. 8). It will be understood that an uppermost end of the bracket 28 is attached, as by welding for example, to the inwardly facing surface of the table 16. Each carriage assembly 25 is thus connected between the table 16 and one of the side walls 14 and 15 so as to permit smooth, displaceable movement of the table 16 with respect to the cutting tool assembly 17. In FIG. 8, a longitudinal cross-sectional view of the stand 13' shows clearly the placement of one carriage assembly 25 on the side wall A handle 29 is shown in FIG. 2 as part of a feed mechanism for advancing the table 16 towards the assembly 17 and subsequently returning the feed table after the end of the stake is sharpened. The translation of rotary motion to rectilinear motion between the handle 29 and the table 16 is best seen in FIG. 8. An end 35 of the handle 29 is attached to an elongated cam 36 that extends into a pocket 37 defined by front and back walls 38 and 39, respectively, which are disposed centrally between the angle brackets 28 as depicted in FIGS. 5 and 8. Rotary movement of the handle 29 towards the assembly 17 rotates the cam 36 which makes contact with an inside surface of the front wall 38 causing the table 16 to move rectilinearly in the direction of handle rotation. Conversely, rotation of the handle 29 in the opposite direction brings the cam 36 to bear against the inside surface of the back wall 39, thereby returning the table 16.

In the embodiment illustrated in FIG. 8, a coiled spring 40 has one end connected to the cam 36 at an aperture 41 and an opposite end connected to the side wall 14 at an aperture 42. The spring stretches restorably as the table 16 is advanced towards the assembly 17 and returns the table 16 to its rest position when the handle 29 pressure is released.

Workpiece support means comprise a hollow tube 46, open at both ends, which is adapted to receive and support a workpiece and to retain the free end thereof in cutting engagement with the cutting plane 21. Although not illustrated, it will be understood that a workpiece in the form of a wooden stake, preferably of square cross-section but not necessarily restricted thereto, is received at an uppermost end of the tube 46 and exits at the lowermost end thereof which has an ellipsoid portion 47 cut away as best seen in FIG. 5. A free end of the stake would extend beyond the portion 47 and abut a workpiece stop 48 which comprises a pair of brackets 49 and 50 as shown in FIG. 5. The free end of the stake extending through the ellipsoid portion 47 is also brought into contact with the cutting plane 21 by rotation of the handle 29 as described. The rotating blades 19 then cut away a portion of the exposed stake, with the cut portion being determined by the angular position of the tube 46 in relation to the plane 21. Manual rotation of the stake within the tube 46 results in corresponding cuts around the periphery of the stake at its free end, thereby forming a sharpened point.

The predetermined angles of the tube 46 with respect to the cutting plane 21 and the flat top of the table 16 are set by a pair of support brackets 51 and 52 (FIG. 8). An upper end of each bracket is joined in a conventional manner to the tube 46 while the lowermost end is similarly connected to the table 16.

Figure 6:
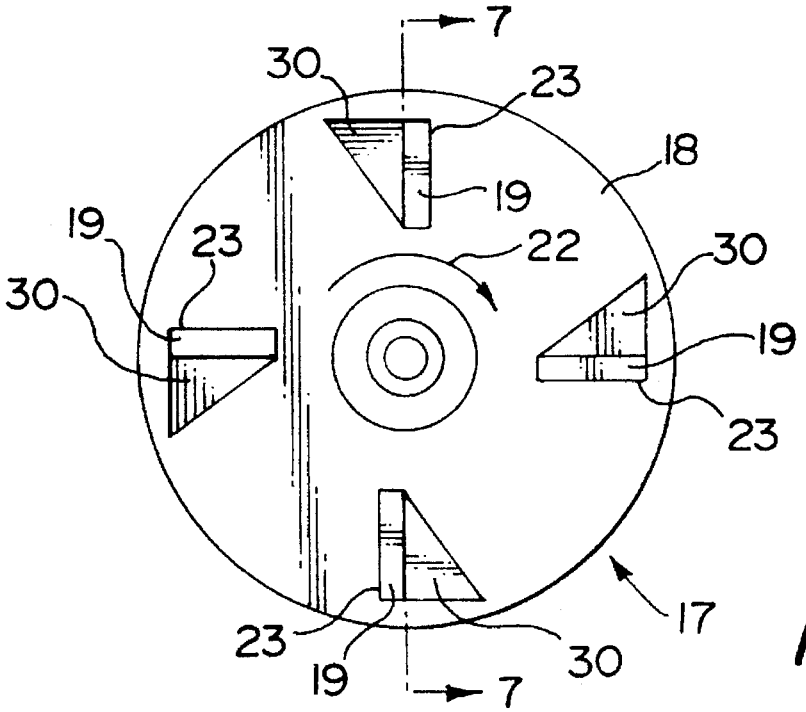
FIG. 6 is an end view of a cutting disk used in the apparatus shown in FIG. 1.

FIG. 6 is a rear elevation view of the disk 18 showing an angled slot 30 through the disk adjacent to and in registry with a cutting edge 23 of each blade 19. Having regard to FIG. 7 it will be observed that the cutting edge 23 is spaced away from the surface of the disk 18 to which the blade is attached. This brings the cutting edge of each blade into the cutting plane 21 and also provides a space 24 between the cutting edge and its corresponding slot to permit the to unobstructed passage therethrough of cutting debris.

Rotation of the disk 18 in the direction of an arrow 22 (FIG. 6) creates air movement through the space 24 and its slot 30 under the influence of a sloping side wall 31 which functions like a fan blade. As a result, a substantial portion of the debris developed in sharpening the workpiece is entrained within the moving air and is drawn through the slot 30 and deposited within the interior of the base 11 for subsequent removal.

Figure 9:
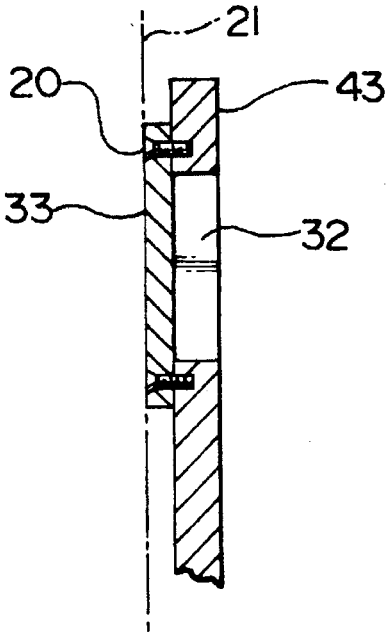
FIG. 9 is a partial cross-sectional view of another embodiment of a cutting disk similar to the disk of FIG. 6.
Figure 10:
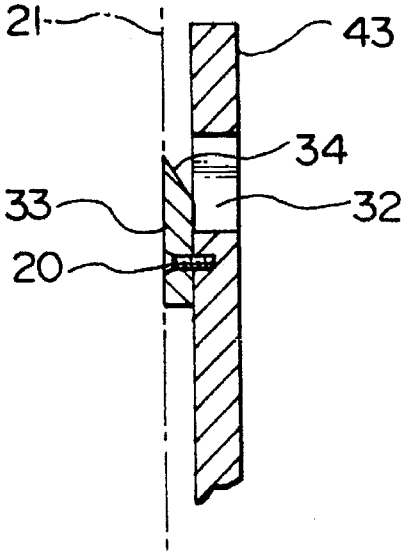
FIG. 10 is another partial cross-sectional view of the disk of FIG. 9.

FIGS. 9 and 10 illustrate partial views in cross section of another cutting tool assembly for removing debris when sharpening a stake. In this embodiment four slots 32, corresponding to slots 30, are formed in a comparatively thin disk 43 which is unlike the thick disk 18. The slots 32 are also unlike the slots 30 in that the former have side walls that are orthogonal to the cutting plane 21 whereas the slots 30 each include a sloping side wall 31 (FIGS. 6 and 7). Air movement through each slot 32 is also produced differently and is achieved by a corresponding cutting blade 33 rotating with the disk 43. FIG. 9 illustrates a sectional side view of the blade 33 mounted on the disk 43, whereas FIG. 10 illustrates a profile end view in section of the blade which shows an angled surface 34 and its position adjacent to and in registry with the slot 32. Each blade 33 is mounted flush against the disk 43 such that the leading edge of the surface 34 lies within the cutting plane 21. It will be understood, therefore, that as the disk 43 rotates, corresponding movement of the surface 34 causes air to be deflected therefrom and pushed through the slot 32. As in the first described embodiment, a substantial portion of the debris formed by the cutting action of each blade 33 is entrained within the moving air and is drawn through each corresponding slot 32 into the interior of the base 11 for subsequent removal.

Figure 3:
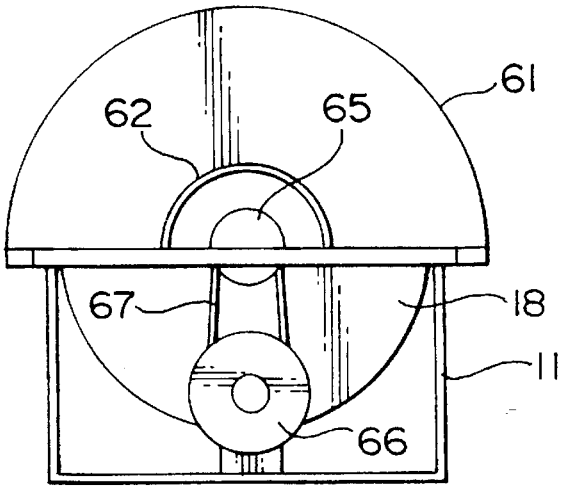
FIG. 3 is a rear elevation view of the apparatus shown in FIG. 1.
Figure 4:
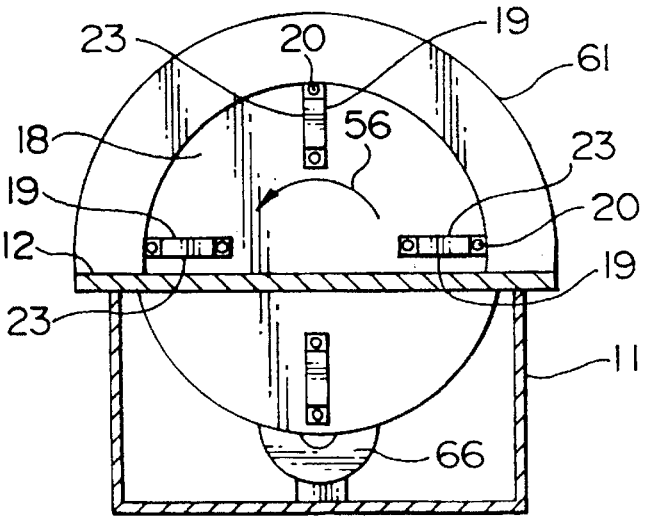
FIG. 4 is a cross-sectional view of the apparatus shown in FIG. 2 taken along the lines 4—4.

A stepped end 60 of the base 11 (FIGS. 1 and 2) supports a cutter safety guard 61 as well as a cover 62 over a drive shaft 63 to which the disk 18 is attached in a known manner via a flange 64. Although not shown in the drawings, it will be understood that the shaft 63 is journalled in a bearing that is conventionally mounted to an upper surface of the stepped end 60 under the cover 62. As may be seen in FIG. 3, a pulley 65 is joined to a free end of the shaft 63 and is rotatably driven by an electric motor 66 via a drive belt 67.

Figure 11:
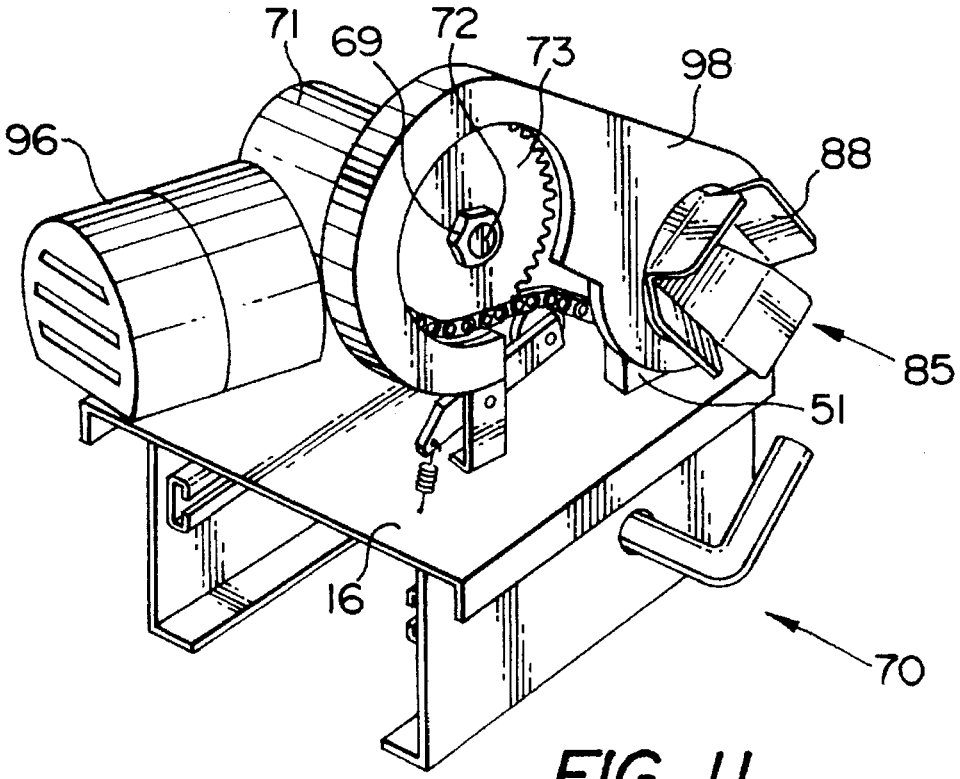
FIG. 11 is a perspective view of a rotatable driver for the apparatus of FIG. 1.
Figure 12:
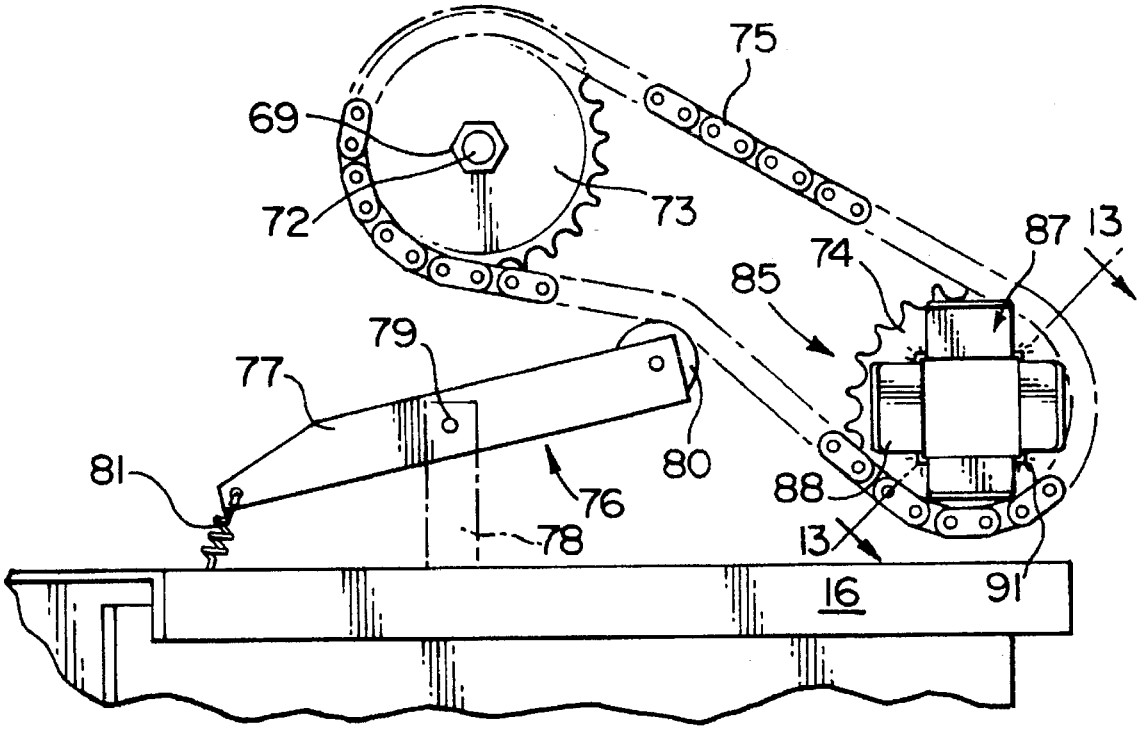
FIG. 12 is an enlarged partial end view of the driver of FIG. 11.
Figure 13:
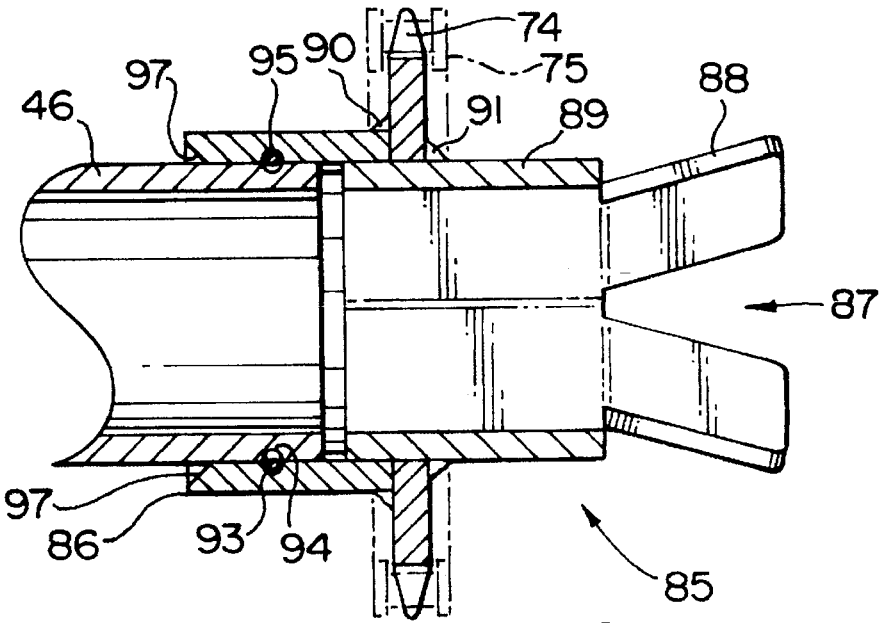
FIG. 13 is a partial cross-sectional view of the driver of FIG. 12 taken along the lines 13—13.

A rotatable driver 70 shown in FIGS. 11–13 provides automatic rotation of a stake instead of manual rotation as disclosed hereinabove. The driver 70 is mounted on the table 16 in operable relation with the tube 46 (FIG. 13) and will be seen to comprise a drive motor 71 having a central shaft 72 to which a drive sprocket 73 is attached by a fastening nut 69. As best seen in FIG. 12, the sprocket 73 is in operable engagement with a driven sprocket 74 via a drive chain 75. Any slack in the chain 75 is taken up by a chain tensioner 76 which comprises a tension arm 77 that is pivotally connected to a mounting post 78 by a pivot pin 79. One end of the arm 77 has rotatably mounted thereon a wheel 80. The opposite end of the arm 77 is connected by means of a coiled spring 81 to the table 16. A force exerted by the spring 81 on the arm 77 raises the wheel 80 into rotatable contact with the chain 75 and takes up chain slack as shown.

The sprocket 74 forms part of a drive assembly 85 shown in a partial, cross-sectional view in FIG. 13. The assembly 85 includes a sleeve bearing 86 of circular section that is rotatably mounted on one end of the tube 46 and is joined to the sprocket 74 at weld joints 90. A workpiece guide 87 includes an entry port defined by a plurality of flared flat side walls 88 extending outwardly from a cylindrical body 89 of square section passing coaxially through a central aperture of the sprocket 74 and joined thereto at weld joints 91.

The assembly 85 is retained in position on the tube 46 by a split ring 93 that is disposed within a corresponding groove 94 formed in the tube 46. A like groove 95 on the inner surface of the bearing 86 engages the ring 93 when the assembly 85 is installed on the tube 46. Installation proceeds by initially installing the ring 93 within the groove 94. A chamfered end 97 of the bearing 86 is then placed in position on the free end of the tube 46. Axial pressure applied to the assembly 85 compresses the ring into the groove 94, permitting the bearing 86 to slide coaxially along the tube 46 until the ring encounters the groove 95. The ring then opens slightly to captively engage both grooves, locking the assembly 85 in rotatable relation with the tube 46.

As the sprocket 74 rotates under influence of the moving chain 75, the assembly 85 is rotated. The tube 46 is stationary, but a stake (not shown) of rectangular or square cross-section inserted into the guide 87 is engaged by the side walls of the body 89 and is rotated as it is urged into the tube to make contact with the stop 48 (FIG. 5). Rotation of the assembly 85 permits the rotating blades 19 to cut away a portion of the exposed stake as determined by the angular position of the tube 46 with respect to the plane 21 which results in the extended end of the stake being formed into a sharpened point. After several revolutions, the sharpened stake may be withdrawn and replaced with a fresh stake which is subjected to the same sharpening procedure.

A protective chain guard 98 prevents accidental contact with the sprockets 73, 74 and the chain 75. The guard 98 has been removed in FIG. 12 to reveal the functional components of the driver 70.

In the embodiment illustrated, the motor 71 has a rotational speed of 27.5 rpm, although it has been determined that a rotational speed in the range of from 20 to 50 rpm will provide satisfactory results. The motor 71 is a capacitor start type but other motor types may be used provided such motors are capable of a rotational speed within the recommended range. In the event that a capacitor start motor is used, an associated capacitor, on-off main power switch and wiring would be protected within a housing 96 mounted on the table 16. An optional microswitch may be mounted on either the side wall 14 or 15 in operable contact with either the handle 29 or the carriage assembly 25 to supply electrical power to the motor 71 alone whenever the handle or carriage assembly are caused to move. These additional components and related wiring are not shown but, being conventional, are known in the art.

To those skilled in the art to whom this specification is addressed, it will be apparent that the embodiments aforedescribed may be varied to meet particular specialized requirements without departing from the true spirit and scope of the invention disclosed. For example, although an electric motor 66 rotatably drives the assembly 17, a small internal combustion engine may be substituted in a field environment. Also, whereas a hollow tube 46 with open ends is described for the workpiece support, such tube may be replaced with an open channel member such as a hollow semicylinder. The foregoing embodiments are therefore not to be taken as indicative of the limits of the invention but rather as exemplary structures thereof which are defined by the claims appended hereto.

The embodiments of the invention in which an exclusive property or privilege is claimed are defined as follows:

1. Apparatus for pinpointing a workpiece, comprising in combination:

a base having a mounting surface thereon;

cutting means rotatably supported on the mounting surface, said means including a flat disk having at least one cutting member radially disposed and secured thereon in a cutting plane of the disk;

drive means mounted on the base and coupled to the cutting means for rotatably driving the disk;

a feed table disposed on the mounting surface in adjacent relation to the cutting plane of the disk;

stand means affixed to the mounting surface in spaced adjacent relation with the cutting plane of the disk, and in supporting relation with the feed table;

carriage means disposed between the stand means and the feed table for positionably supporting the feed table with respect to the cutting plane of the disk;

means cooperatively engaging the stand means and feed table for returnably advancing the table towards the cutting plane of the disk via the carriage means; and a channel member mounted on the feed table, the member having open ends adapted to receive and supportively engage the workpiece and to retain the free end thereof in predetermined angular cutting engagement with the cutting plane of the disk.

2. Apparatus as claimed in claim 1, further comprising at least one bracket for retaining the channel member on the feed table at a predetermined angle with respect to a horizontal surface plane thereof.

3. Apparatus as claimed in claim 2, wherein the at least one bracket is adapted to retain the channel member on the feed table at a predetermined angle with respect to the cutting plane of the disk.

4. Apparatus as claimed in claim 3, wherein the cutting plane of the disk is substantially orthogonal to the mounting surface of the base.

5. Apparatus as claimed in claim 4, wherein the feed table is positionably supported in a plane substantially orthogonal to the cutting plane of the disk.

6. Apparatus as claimed in claim 5, wherein the means for advancing the feed table towards the cutting plane of the disk comprises:

a handle rotatably journalled in a first side wall of the stand means, the handle having an external end adapted to be gripped by an operator and an inner end disposed between the first side wall and a second side wall of the stand means; and a link member operably connecting the feed table to the inner end of the handle for translating rotational movement of the handle into rectilinear movement of the feed table in a predetermined longitudinal direction.

7. Apparatus as claimed in claim 6, further comprising a coiled spring operably connected between the feed table and the mounting surface for returning the feed table from an advanced position at which the free end of the workpiece engages the cutting plane of the disk, to a rest position at which the free end is disengaged therefrom.

8. Apparatus as claimed in claim 1, further comprising a slot traversing the disk in registry with a cutting edge of the at least one cutting member, the slot having a length corresponding to the length of the member and a sloping side wall trailing the cutting edge at a predetermined angle to function as a fan blade for generating an air flow through the slot, whereby debris at the cutting side of the disk are entrained in the air flow and drawn through the slot to the opposite side of the disk in response to disk rotation.

9. Apparatus as claimed in claim 8, wherein the channel member is a hollow semicylinder.

10. Apparatus as claimed in claim 8, wherein the channel member is a hollow cylinder.

11. Apparatus as claimed in claim 8, further comprising:

a plurality of cutting members, the members being uniformly positioned, radially outwardly disposed and secured to the disk in the cutting plane thereof; and a like plurality of slots traversing the disk in registry with the cutting members.

12. Apparatus as claimed in claim 1, further comprising a slot traversing the disk in registry with a leading edge of a sloping cutting surface of the at least one cutting member, the cutting surface facing the slot and functioning as a fan blade for generating an air flow through the slot, whereby debris at the cutting side of the disk are entrained in the air flow and drawn through the slot to the opposite side of the disk in response to disk rotation.

13. Apparatus as claimed in claim 12, further comprising:

a plurality of cutting members, the members being uniformly positioned, radially outwardly disposed and secured to the disk in the cutting plane thereof; and a like plurality of slots traversing the disk in registry with the cutting members.

14. Apparatus as claimed in claim 1, further comprising a rotatable driver operably joined to an entry end of the channel member for receiving and rotating the workpiece as it is fed through the channel member into engagement with the cutting plane of the disk.

15. Apparatus as claimed in claim 14, wherein the rotatable driver comprises:

a sleeve bearing having one end adapted for coaxial and rotatable engagement with the open end of the channel member;

a driven sprocket having one side thereof joined to the free end of the sleeve bearing in coaxial alignment therewith; and a workpiece guide joined to the free side of the sprocket in coaxial alignment with a central aperture therethrough, the guide having an entry port defined by a plurality of outwardly extended flared flat side walls adapted to guide a workpiece into the channel member and at least one side wall adapted to rotatably engage the workpiece.

16. Apparatus as claimed in claim 15, wherein the rotatable driver further comprises:

an electrical drive motor having an output shaft with a predetermined low speed of rotation;

a drive sprocket coaxially joined to a free end of the shaft;

a drive chain entrained about the sprockets; and circuit means for selectively connecting the motor to an electrical power source.

* * * * *